US007765763B2

(12) United States Patent
Teng et al.

(10) Patent No.: US 7,765,763 B2
(45) Date of Patent: Aug. 3, 2010

(54) PLEATED ROOFING MEMBRANE AND ROOFING SHINGLE SYSTEM

(75) Inventors: Yihsien H Teng, Westerville, OH (US); Edward R Harrington, Jr., Toledo, OH (US); Lawrence J Grubka, Westerville, OH (US)

(73) Assignee: Owens Corning Intellectual Capital, LLC DE (US)

( * ) Notice: Subject to any disclaimer, the term of this patent is extended or adjusted under 35 U.S.C. 154(b) by 397 days.

(21) Appl. No.: 11/648,074

(22) Filed: Dec. 30, 2006

(65) Prior Publication Data

US 2008/0155923 A1 Jul. 3, 2008

(51) Int. Cl.
*E04D 1/00* (2006.01)

(52) U.S. Cl. ..... 52/518; 52/413; 52/552; 52/748.1; 52/746.11; 52/528

(58) Field of Classification Search ..... 52/97, 52/408–411, 413, 416, 478, 518, 552, 553, 52/748.1, 749.12, 746.11, 748.11, 528, 551
See application file for complete search history.

(56) References Cited

U.S. PATENT DOCUMENTS

| | | | | | |
|---|---|---|---|---|---|
| 851,331 | A * | 4/1907 | Wardell | 442/323 |
| 4,171,599 | A * | 10/1979 | Lipp | 52/528 |
| 4,217,742 | A * | 8/1980 | Evans | 52/553 |
| 4,226,069 | A * | 10/1980 | Hinds | 52/521 |
| 4,671,036 | A | 6/1987 | Sullivan | |
| 4,706,435 | A | 11/1987 | Stewart | |
| 4,717,614 | A | 1/1988 | Bondoc et al. | |
| 5,065,553 | A * | 11/1991 | Magid | 52/58 |
| 5,165,210 | A * | 11/1992 | Partyka et al. | 52/746.11 |
| 5,259,166 | A * | 11/1993 | Carey et al. | 52/749.12 |
| 5,428,931 | A * | 7/1995 | Ragsdale | 52/518 |
| 5,570,553 | A | 11/1996 | Balkins | |
| 5,775,042 | A * | 7/1998 | Mowery et al. | 52/520 |
| 6,021,616 | A | 2/2000 | Mayle | |
| 6,510,664 | B2 * | 1/2003 | Kupczyk | 52/528 |
| 6,516,572 | B1 | 2/2003 | Nowacek et al. | |
| 6,696,125 | B2 * | 2/2004 | Zanchetta et al. | 428/40.1 |
| 6,804,919 | B2 | 10/2004 | Railkar | |
| 6,852,185 | B2 * | 2/2005 | Sanger | 156/71 |
| 6,990,779 | B2 | 1/2006 | Kiik et al. | |

(Continued)

FOREIGN PATENT DOCUMENTS

| | | |
|---|---|---|
| EP | 1 541 337 | 6/2005 |

OTHER PUBLICATIONS

International Search Report dated Jun. 4, 2008 in PCT/US2007/25916.

*Primary Examiner*—David Dunn
*Assistant Examiner*—Joshua Ihezie
(74) *Attorney, Agent, or Firm*—James J. Dottavio

(57) ABSTRACT

This invention relates to an underlayment for use under a plurality of courses of roofing shingles. The underlayment includes a water impermeable membrane layer containing at least one flap extending horizontally across the membrane layer. The flap is movable between a flat position and a raised position. In the raised position, an upper edge of a roofing shingle can be positioned under the flap. The upper edge of the roofing shingle can then be subsequently overlapped by the flap when the flap is moved into the flat position. The flap can then subsequently be overlapped by another course of roofing shingles.

14 Claims, 6 Drawing Sheets

U.S. PATENT DOCUMENTS

| | | | | |
|---|---|---|---|---|
| 7,124,548 | B2 * | 10/2006 | Pressutti et al. | 52/518 |
| 2003/0040241 | A1 | 2/2003 | Kiik et al. | |
| 2004/0163351 | A1 * | 8/2004 | Rood, Jr. | 52/528 |
| 2004/0182032 | A1 | 9/2004 | Koschitzky | |
| 2004/0206035 | A1 | 10/2004 | Kandalgaonkar | |
| 2005/0053745 | A1 | 3/2005 | Bartek et al. | |
| 2005/0204674 | A1 * | 9/2005 | Marshall | 52/544 |
| 2008/0028708 | A1 * | 2/2008 | Albora | 52/408 |

* cited by examiner

PLEATED ROOFING MEMBRANE AND ROOFING SHINGLE SYSTEM

TECHNICAL FIELD

This invention relates to roofing materials. More particularly, the invention pertains to a roofing underlayment for use underneath roofing shingles that do not have a traditional headlap portion.

BACKGROUND OF THE INVENTION

This invention relates generally to roofing materials, and more particularly to an underlayment material for a roofing shingle system. Most known roofing shingle products are traditionally comprised of a headlap portion and a buttlap portion. The headlap portion of the roofing shingle provides part of the weather resistance of the roofing shingle, such as water and wind resistance, as well as other weathering characteristics. Traditionally, the headlap portion accounts for over fifty percent of the vertical width of the roofing shingle. In an effort to reduce manufacturing and delivery costs as well as to ease installation of the roofing shingles, alternate headlap construction roofing shingle configurations have emerged into the marketplace. Several examples of such alternate headlap construction roofing shingle configurations can be found in U.S. Pat. No. 6,990,779, the disclosure of which is herein incorporated by reference in its entirety. In order to maintain acceptable weathering characteristics of such alternate headlap construction roofing shingles, it is necessary to install an intermediate layer between the roof deck and the roofing shingle to replace the traditional headlap portion of the shingle. Several of such intermediary layers are known, such as the interply layer disclosed in U.S. Pat. No. 6,990,779 incorporated above. However, such intermediary layers often significantly increase the complexity of the installation of the alternate headlap construction shingles, as well as create a potential for compromised wind and waterproofing performance. Hence, there is a need for an improved intermediary layer for use roofing shingles having alternative headlap portion constructions.

SUMMARY OF THE INVENTION

This invention relates to an underlayment for use under a plurality of courses of roofing shingles. The underlayment includes a water impermeable membrane layer. The membrane layer preferably contains at least one flap extending horizontally across the membrane layer. The flap is preferably movable between a flat position and a raised position. In the raised position, an upper edge of a roofing shingle can be positioned under the flap such that the upper edge of the roofing shingle can be subsequently overlapped by the flap when the flap is moved into the flat position. The flap can then preferably be subsequently overlapped by another course of roofing shingles.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
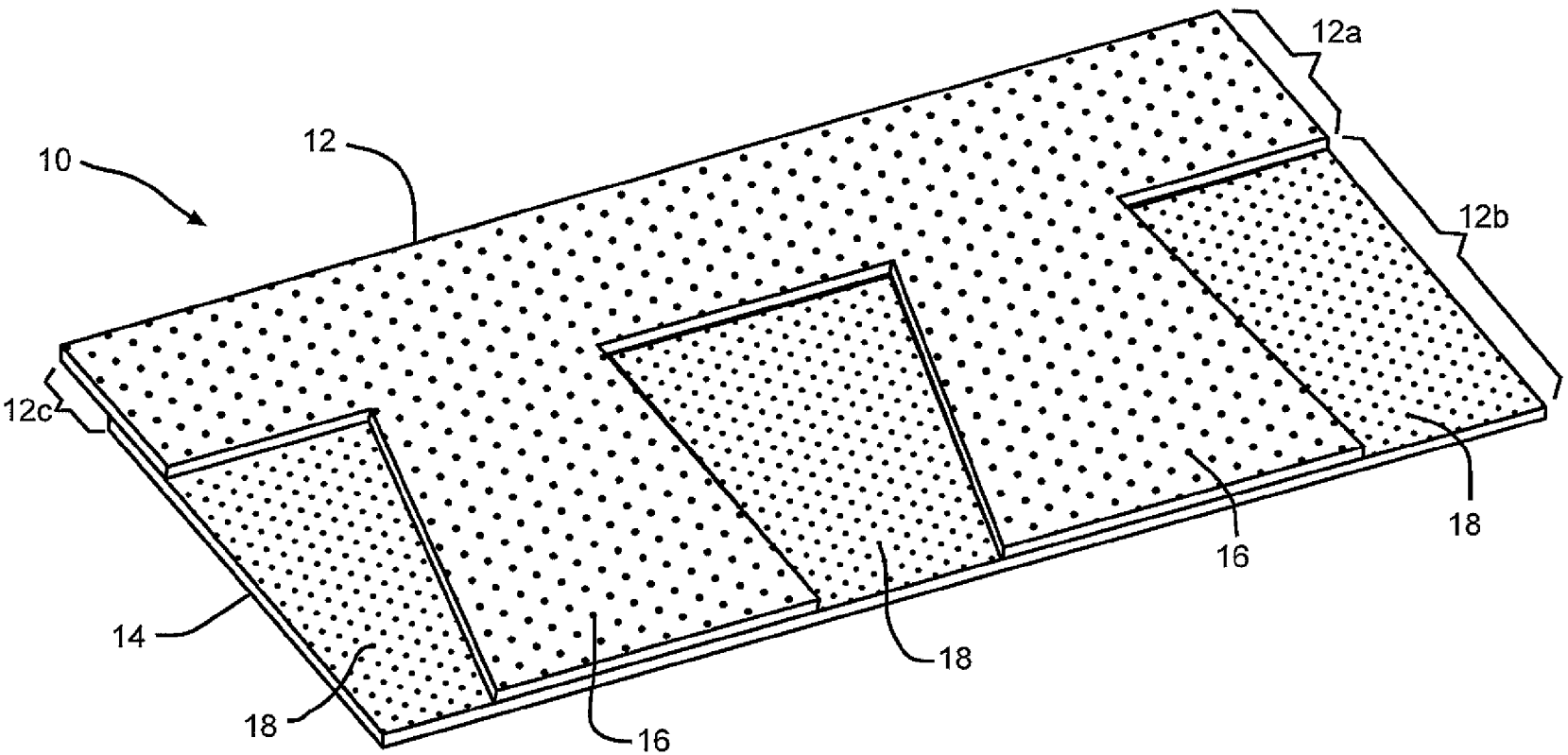
FIG. 1 Prior Art
FIG. 1 is a perspective view of a roofing shingle having an alternate headlap construction.

Referring now to the drawings, there is illustrated in FIG. 1 an example of a roofing shingle having an alternate headlap construction for use with the roofing underlayment of the present invention. It will be appreciated that the illustrated roofing shingle is, in large measure, conventional in the art and is intended merely to illustrate one environment in which this invention may be used. Thus, the scope of this invention is not intended to be limited for use with the specific structure for the roofing shingle illustrated in FIG. 1. On the contrary, as will become apparent below, this invention may be used in any desired environment for the purposes described below. The illustrated roofing shingle, indicated generally at 10, is a laminated shingle comprised of an overlay or first shingle sheet 12, and an underlay or second shingle sheet 14. The first shingle sheet 12 has a headlap portion 12*a* and a buttlap portion 12*b*. The buttlap portion 12*b* includes a plurality of tabs 16 that are spaced apart to define one or more cutouts 18 between the tabs 16. The second shingle sheet 14 is attached to the underside of the first shingle sheet 12 and has portions exposed through the cutouts 18 between the tabs 16. The configuration and arrangement of tabs 16 and cutouts 18 of the shingle sheets 12 and 14 create a multidimensional roofing shingle 10.

The first shingle sheet 12 and second shingle sheet 14 can be made from any suitable materials, such as asphalt coated fiberglass mat. It will be appreciated that the shingle sheets 12 and 14 may also be made from any other suitable materials, such as organic felt or other types of base material. Accordingly, the present invention is not limited to use with shingles including a fiberglass mat. The shingle sheets 12 and 14 can be adhered together by any suitable means, such as by gluing the second shingle sheet 14 to the underside of the first shingle sheet 12. In the illustrated embodiment, the first shingle sheet 12 has a greater vertical width than the second shingle sheet 14, which creates a single ply nailing zone 12*c* within the headlap portion 12*a* of the first shingle sheet 12. The first and second single sheets 12, 14 may also have the same vertical width, resulting in a multiple layer nailing zone (not shown) in the headlap portion 12*a* as well. It will also be appreciated that the nailing zone 12*c* can account for any suitable portion of the headlap portion 12*a*, and that the nailing zone 12*c* can be located at any suitable point within the headlap portion 12*a* as well. The headlap portion 12*a* can also contain an adhesive strip (not shown) along the uppermost edge of the headlap portion 12*a*, although such is not required. The adhesive strip can be used for positioning and securing the roofing shingle 10. The resulting laminated shingle 10 preferably has a generally rectangular configuration, although it will be appreciated that the shingle 10 may be any other suitable shape as well.

The laminated shingle 10 has a reduced headlap portion 12*a* relative to traditional roofing shingle designs. Preferably, the vertical width of the headlap portion 12*a* accounts for an amount within the range of from about 10 percent to about 45 percent of the overall vertical width of the roofing shingle 10. More preferably, the vertical width of the headlap portion 12*a* accounts for an amount within the range of from about 20 percent to about 40 percent of the overall vertical width of the roofing shingle 10. Accordingly, the buttlap portion 12*b* of the shingle 10 preferably accounts for an amount within the range of from about 55 percent to about 90 percent, and more preferably for an amount within the range of from about 60 percent to about 80 percent, of the overall vertical width of the roofing shingle 10. The shingle 10 may have any suitable dimensions, with the headlap portion 12*a* and the buttlap portion 12*b* correspondingly apportioned as described above. For example, a shingle having the dimensions of 13.25 inches in vertical width and 36 inches in horizontal length would preferably have a buttlap portion 12*b* within the range of from about 7.29 inches in vertical width to about 11.93 inches in vertical width, and more preferably would have a buttlap portion 12*b* within the range of from about 7.95 inches in vertical width to about 10.60 inches in vertical width. Additionally, a shingle may include an entire headlap region and/or nail zone in the headlap comprising a reinforcement as described in copending U.S. patent application Ser. No. 11/198,522, which is incorporated herein by reference in its entirety.

As discussed above, the laminated roofing shingle 10 described above is one of many environments in which the underlayment of the present invention may be used. Another example of a roofing shingle with which the underlayment of the present invention can be used includes a strip type of shingle with an alternate headlap construction. The strip shingle may be a single layer shingle, or it may also contain multiple layers of roofing material. Both the single layer and multiple layer strip shingle configurations may contain cutout portions, such as the cutout configuration described above, although such is not required.

Figure 2:
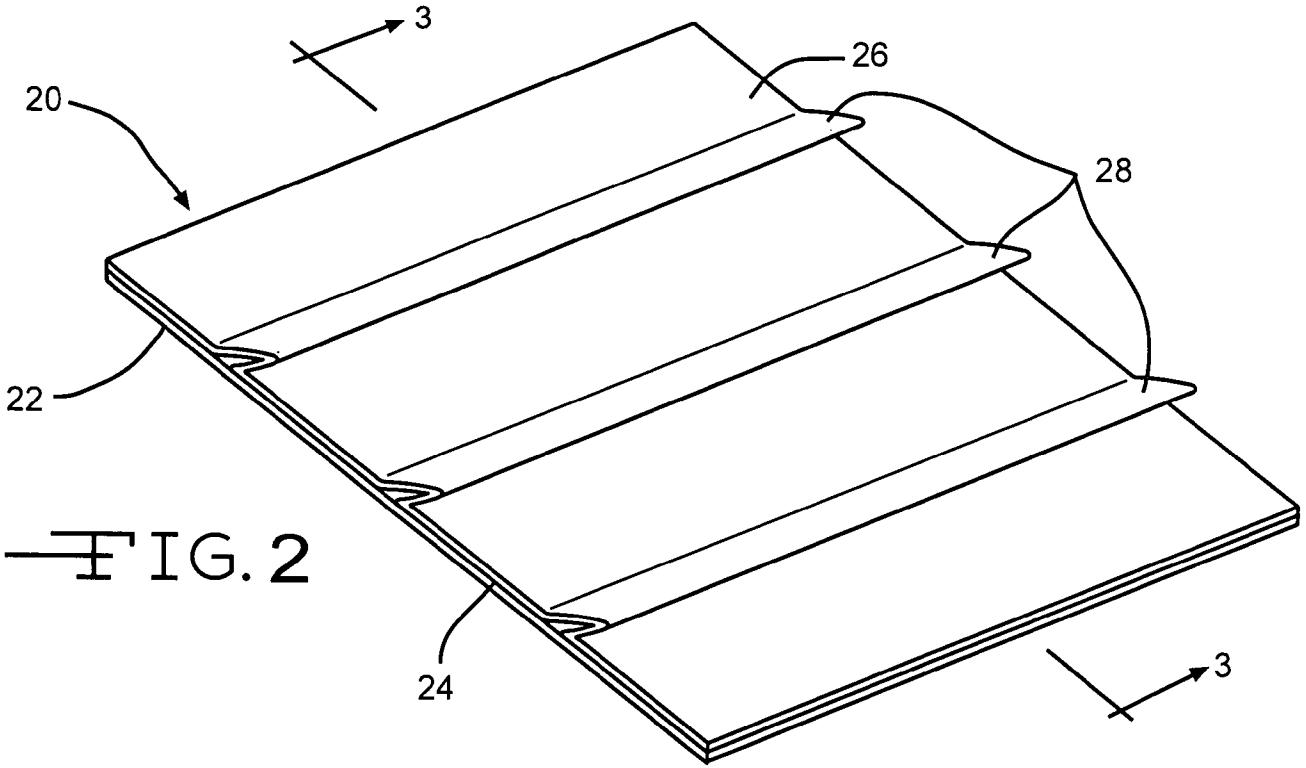
FIG. 2 is a perspective view of one embodiment of the underlayment of the present invention.
Figure 3:
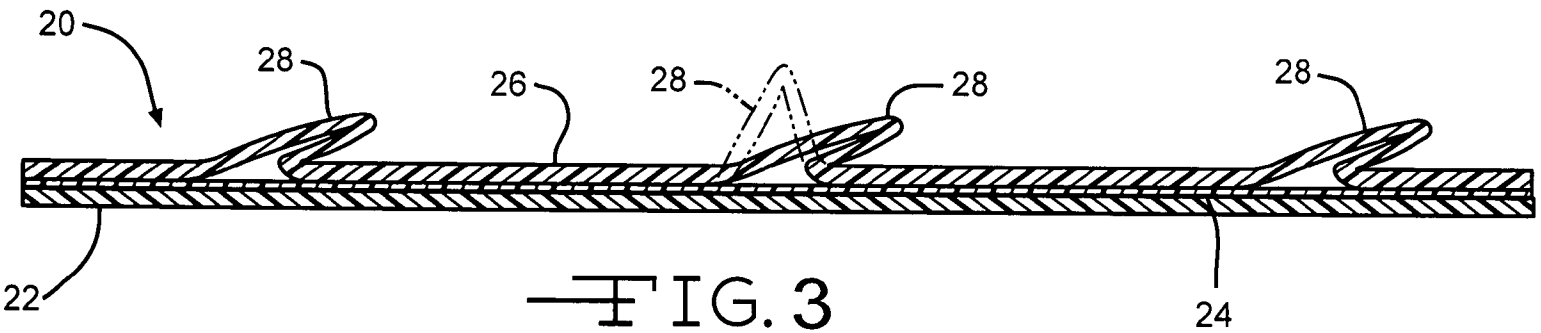
FIG. 3 is a sectional view of the underlayment of the present invention taken along section line 3-3 in FIG. 2.

FIGS. 2 and 3 illustrate an underlayment for use with the present invention. The underlayment, indicated generally at 20, is used under the shingles 10 discussed above. Preferably, the underlayment 20 is positioned between a roof decking material (indicated at 13 in FIGS. 6 and 7) and under a plurality of courses of roofing shingles 10 that are installed on the roof decking 13 to form a roof. In some instances, an additional layer of roof felt or other base material (not shown) may be placed between the roof deck 13 and the underlayment 20 of the present invention, although such is not required.

A preferred underlayment 20 may include a base layer 22, although such is not required. The base layer 22 can be formed from any suitable weather resistant material or combination of materials. Examples of such suitable materials include, but are not limited to, asphalt based materials, polymer materials, foil sheet, fiber reinforcements, mesh, mat, scrim, fabric, filler, fire retardant, or mineral materials. The base layer 22 may have a layer of adhesive material applied to the back side thereof for applying the underlayment 20 to the roof deck 13 or a layer of roof felt or other base material, although such is not required. Where adhesive is applied to the base layer 22, any adhesive material suitable for joining the underlayment 20 to the roof deck 13 or base material may be used. An adhesive layer 24 is then preferably applied over the base layer 22, although such is not required. The adhesive material used for the adhesive layer 24 can be any suitable adhesive for securely joining the layers of the underlayment 20 together, such as water based acrylic adhesives, solvent based adhesives, asphalt based adhesives, or thermoresin materials. A reinforcing material may be positioned over the adhesive material of the adhesive layer 24 as well, although such is not required. The reinforcing material is preferably a mat, mesh, or scrim of glass fiber or polymer fiber, although any suitable reinforcing material and reinforcing material configuration, such as discontinuous fibers, may also be used. The reinforcing material is preferably configured such that there are open spaces amongst the reinforcing materials that allow the adhesive material of the adhesive layer 24 to fill and flow through the spaces and adhere the various layers of the underlayment 20 to one another. It will be appreciated that the adhesive layer 24 can contain additional materials or have other suitable configurations as well, such as including fire retardant and/or other filler material. These additional materials may be incorporated into the adhesive material of the adhesive layer 24, or may be separately applied over the base layer 22. Examples of such additional materials include, but are not limited to, materials containing aluminum hydroxide, borates, phosphates, carbonates, or any other fire retardant or filler material.

A membrane layer 26 is preferably applied over the base layer 22 and adhesive layer 24. The membrane layer 26 contains a series of flaps 28 that extend horizontally across the membrane layer 26. The flaps 28 are preferably integrally formed into the membrane layer 26, although it will be appreciated that the flaps may also be separately formed and attached to the membrane layer 26 by any suitable means. The flaps 28 may be formed in any suitable manner, and are preferably formed as a series of horizontally extending pleats on the membrane layer 26. As best shown in FIG. 3, the flaps 28 formed by the pleats are preferably pliable and are sufficiently flexible to enable the flaps 28 to be moved easily between a flat position and a raised position. When the flaps 28 are in the raised position, the upper edge of a course of roofing shingles 10 can be positioned and fastened to the portion of the underlayment 20 that is subsequently overlapped by the flaps 28 when the flaps 28 are moved into the flat position. The function of the underlayment 20 will be discussed in greater detail below. The flaps 28 may have any suitable dimensions. Preferably, the flaps 28 extend across the entire horizontal length of the underlayment 20, although such is not required. The flaps 28 may be of any suitable width for covering the upper edge of the courses of roofing shingles placed underneath the flap 28, as discussed above. Preferably, the width of the flaps 28 is within the range of from about ½ inch to about 3 inches wide. The flaps 28 may also have a sealing tape or other suitable adhesive material applied to the underside thereof for further securing the roofing shingles 10 underneath the flaps 28, although such is not required. The flaps 28 may also include an adhesive material on the top surface thereof for securing a subsequent layer of roofing shingles to the underlayment 20, although such is not required. The membrane layer 26 can be formed from any suitable water impermeable material, including but not limited to synthetic polymers, elastomers, bitumen, polymer-modified bitumen, metal foils, and coated fabric.

Figure 4:
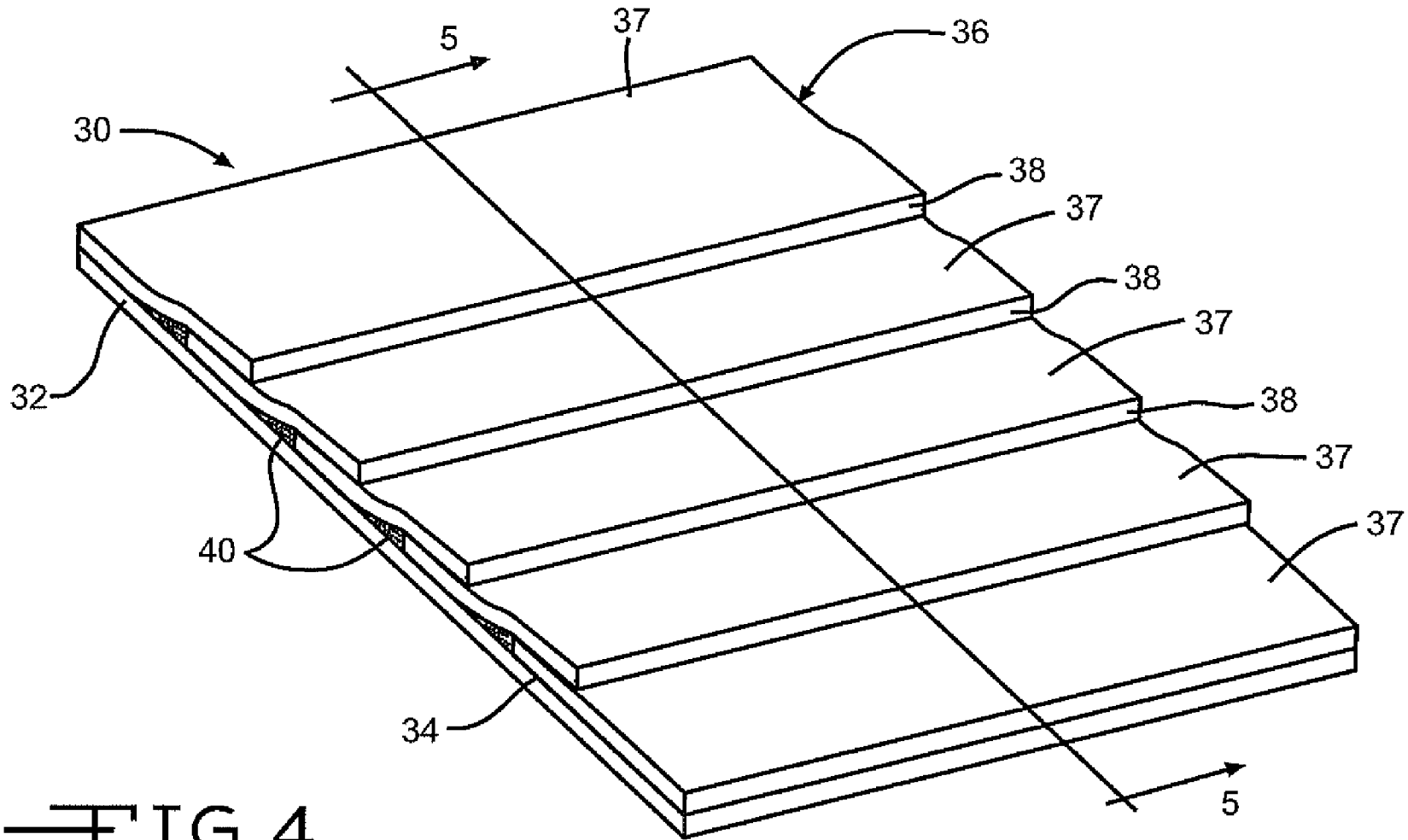
FIG. 4 is a perspective view of another embodiment of the underlayment of the present invention.
Figure 5:
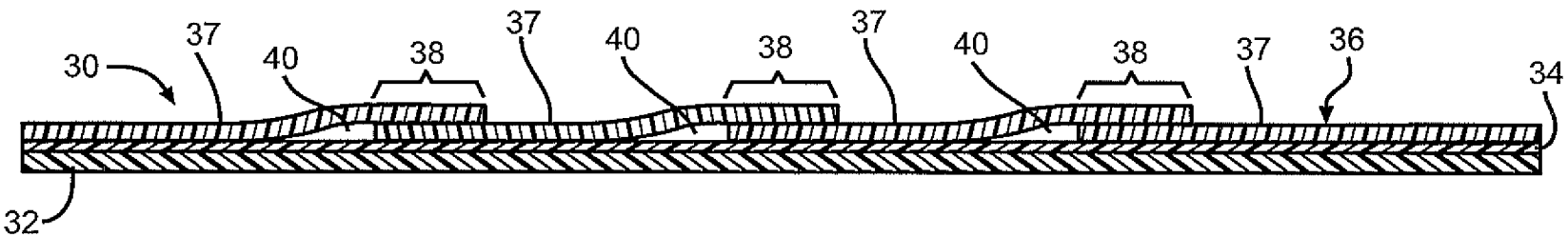
FIG. 5 is a sectional view of the underlayment of the present invention taken along section line 5-5 in FIG. 4.

FIGS. 4 and 5 illustrate another embodiment of an underlayment of the present invention. In this embodiment, the underlayment 30 is comprised of a base layer 32. The base layer 32 can be formed from any suitable weather resistant material or combination of materials, including but not limited to asphalt based materials, polymer materials, foil sheet, fiber reinforcements, mesh, mat, scrim, fabric, filler, fire retardant, or mineral materials. The base layer 32 may have a layer of adhesive material applied to the back side thereof for applying the underlayment 30 to a roof deck or to a layer of roof felt or other base material, although such is not required. Where adhesive is applied to the base layer 32, any adhesive material suitable for joining the underlayment 30 to a roof deck may be used. A layer of adhesive 34 is then preferably applied over the base layer 32, although such is not required. The adhesive material can be any suitable adhesive for securely joining the layers of the underlayment 30 together, such as water based acrylic adhesives, solvent based adhesives, asphalt based adhesives, or thermoresin materials. Along with these adhesive materials, a reinforcing material may be positioned over the adhesive material if needed. The reinforcing material is preferably a mat, mesh, or scrim of glass fiber or polymer fiber, although any suitable reinforcing material and reinforcing material configuration, such as discontinuous fibers, may also be used. The reinforcing material is preferably configured such that there are open spaces amongst the reinforcing materials that allow the adhesive material of the adhesive layer 34 to fill and flow through the spaces and adhere the various layers of the underlayment 30 to one another. It will be appreciated that layer of adhesive 34 can have any other suitable configuration as well, such as including fire retardant and/or other filler material, although such is not required. These additional materials may be incorporated into the adhesive material, or may be separately applied over the base layer 32. Examples of such additional materials include, but are not limited to, materials containing aluminum hydroxide, borates, phosphates, carbonates, or any other fire retardant material.

As clearly shown in FIGS. 4 and 5, a membrane layer 36 is applied over the base layer 32 and adhesive layer 34. The membrane layer 36 comprises a plurality of overlapping membrane portions 37. The overlapping membrane portions 37 of the membrane layer 36 define a series of flaps 38, wherein one flap 38 is integrally formed in each membrane portion 37. The flaps 38 extend horizontally across the membrane layer 36. In this embodiment, the membrane layer 36 is formed from strips of membrane material or membrane portions 37 that are permanently joined together such that vertically adjacent strips of the membrane material 37 are arranged in a partially overlapping relationship to form the flaps 38 on the membrane layer 36. Unlike the flaps 28 that are integrally formed into the membrane layer 26, as described above and shown in FIG. 3, each flap 38 is separately formed as a portion of a membrane portion 37. An adhesive material 40 is used to permanently join the strips of membrane material 37 together to form the membrane layer 36. Any suitable type of adhesive material 40 may be used. Examples of such suitable adhesive materials include, but are not limited to water based acrylic adhesives, solvent based adhesives, asphalt based adhesives, or thermoresin materials.

When the flaps 38 are in the raised position, the upper edge of a course of roofing shingles 10 can be positioned and fastened to the portion of the underlayment 30 that is subsequently overlapped by the flaps 38 when the flaps 38 are moved into the flat position. The function of the underlayment 30 will be discussed in greater detail below. The flaps 38 may have any suitable dimensions. Preferably, the flaps 38 extend across the entire horizontal length of the underlayment 30, although such is not required. The flaps 38 may be of any suitable width for covering the upper edge of the courses of roofing shingles placed underneath the flap 38, as discussed above. Preferably, the width of the flaps 38 is within the range of from about ½ inch to about 3 inches wide. The flaps 38 may also have a sealing tape or other suitable adhesive material applied to the underside thereof for further securing the roofing shingles 10 underneath the flaps 38, although such is not required. The flaps 38 may also include an adhesive material on the top surface thereof for securing a subsequent layer of roofing shingles to the underlayment 30, although such is not required. The membrane layer 36 can be formed from any suitable water impermeable material, including but not limited to synthetic polymers, elastomers, bitumen, polymer-modified bitumen, metal foils, and coated fabric.

Figure 8:
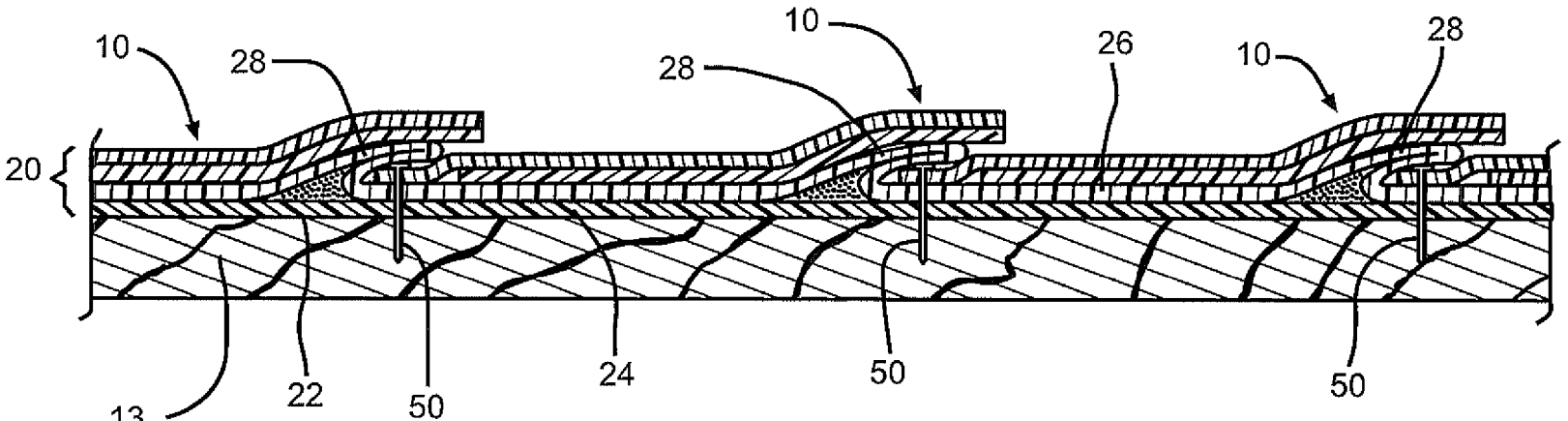
FIG. 8 is a sectional view of the roofing system of the present invention taken along section line 8-8 in FIG. 7.
Figure 6:
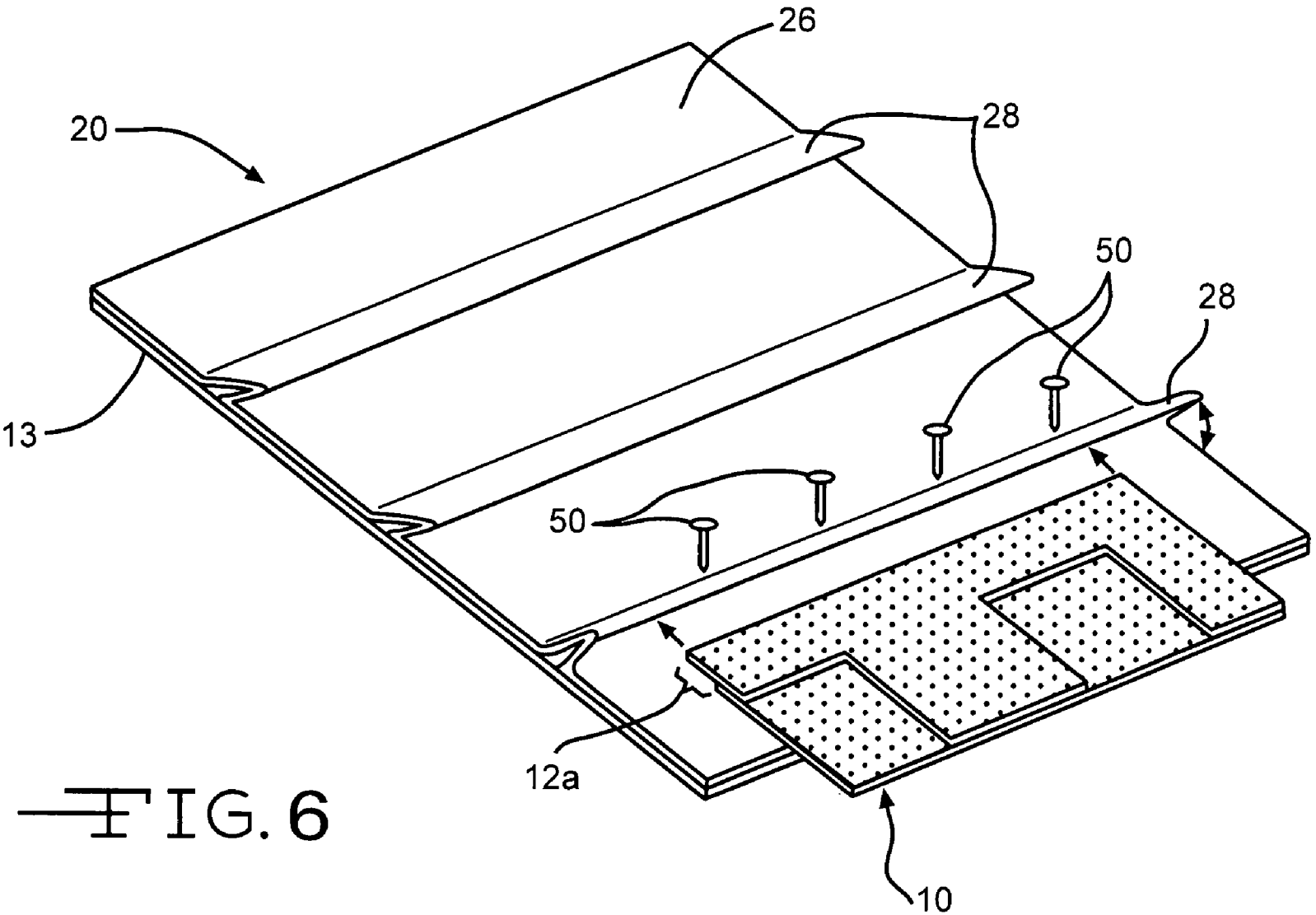
FIG. 6 is a partially exploded perspective view of the roofing system of the present invention.
Figure 7:
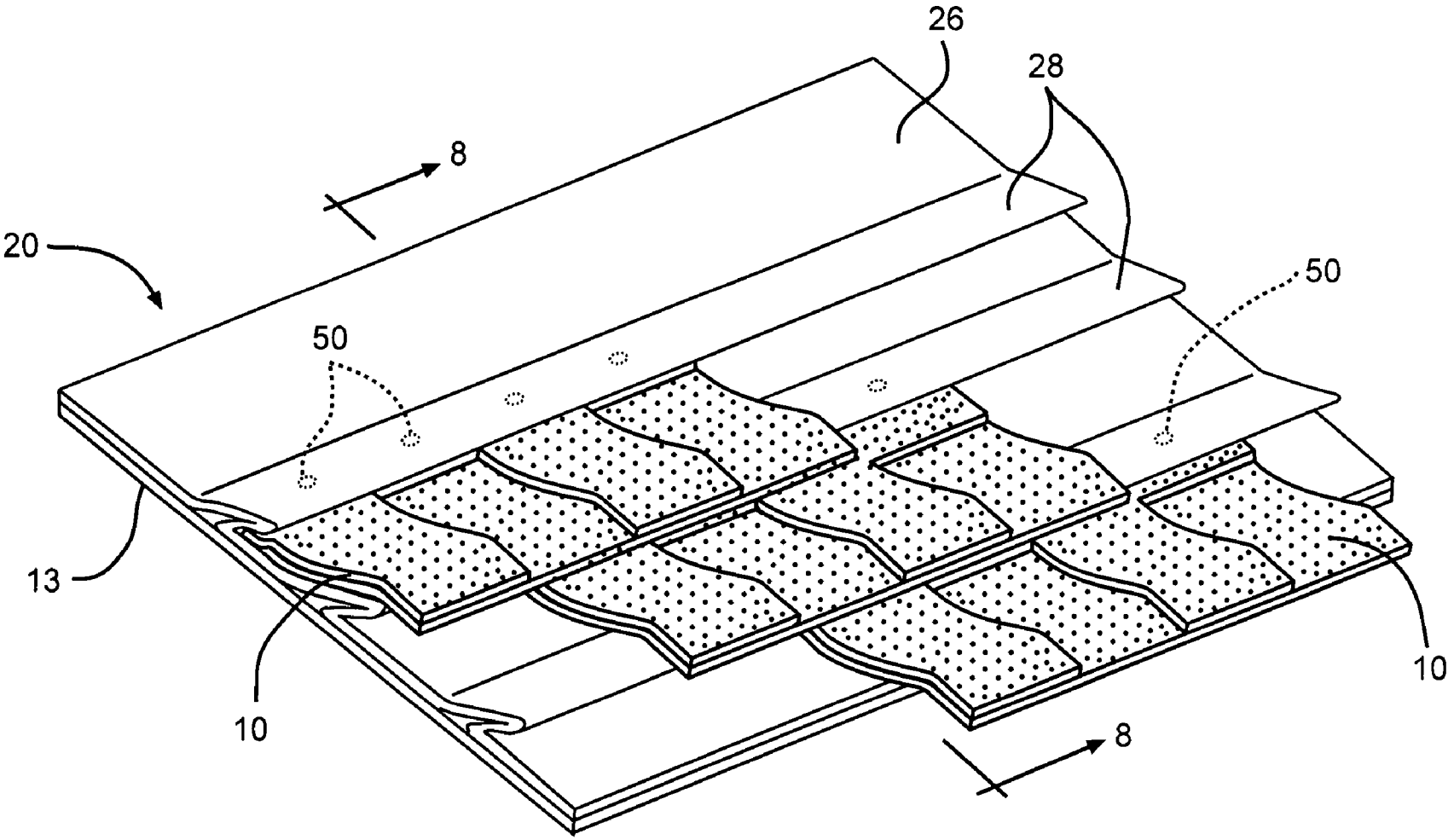
FIG. 7 is a perspective view of the roofing system of the present invention.

FIGS. 6 through 8 illustrate the installation of an underlayment 20 in a roofing system with reduced headlap portion shingles. As discussed above, the underlayment 20 is applied either directly to a roof deck 13 or over another layer of base material, such as roof felt. It will also be appreciated that the underlayment 20 can be applied to an existing shingle covered roof deck. The underlayment 20 may also be adhered to the roof deck, base material, or existing shingle layer by a layer of back adhesive applied to the bottom of the underlayment 20, also as discussed above. To install a course of roofing shingles 10 to the roof, the flap 28 of the underlayment is lifted to its raised position, as best shown in FIG. 6. Once the flaps 28 is raised, a portion of the nail zone 12*c* of the shingle 10 is positioned on the portion of the underlayment 20 that will subsequently be overlapped by the flap 28 when the flap 28 is moved into the flat position. The roofing shingle 10 is then secured into position using any suitable method. Preferably, nails 50 or other suitable mechanical fasteners are placed through the portion of the nail zone 12*c* that will subsequently be covered by the flap 28 when the flap 28 is moved into the flat position. Alternatively, the nails 50 may also be placed through the portion of the nail zone 12*c* or headlap portion 12*a* that is not covered by the flap 28 when the flap is moved into the flat position. In another alternate embodiment, the flap 28 may be moved into the flat position after the nail zone 12*c* is positioned under the flap 28 and the nails 50 may be inserted through the flap 28 to secure the roofing shingle 10 to the roof deck 13. In still another embodiment of the invention, the roofing shingles 10 may be secured under the flaps using adhesives applied either to the roofing shingle 10 itself, or may be secured by adhesives applied to the underside and/or top portion of the flap 28, as discussed above. In one embodiment, the underlayment is secured to the roof deck and the shingles are adhered to the underlayment flaps and the shingles are adhered to each other using a sealant, and no nails are used to install such shingles. It will also be appreciated that any combination of mechanical fasteners and adhesive materials may also be used to position the roofing shingle 10 under the flap 28 of the underlayment 20 and also to secure the roofing shingle 10 to the roof deck 13. The process of positioning the individual roofing shingles 10 and fastening the shingles 10 to the underlayment 20 and roof deck 13 is repeated across the entire horizontal length of the flap 28 to complete a course of roofing shingles 10. As best shown in FIGS. 7 and 8, once the individual roofing shingles 10 are positioned or once the course of roofing shingles 10 is complete, the flap 28 can be moved into the flat position. When the flap 28 is in the flat position, the flap 28 will overlap a portion of the nail zone 12*c* and/or the headlap portion 12*a* of the roofing shingle 10 as well as the nails 50 placed into the nail zone and/or headlap portion 12*a*. By covering the nails 50 with the flap 28, superior water and other weather proofing characteristics are achieved while using a roofing shingle 10 having a reduced headlap portion 12*a* relative to a traditional roofing shingle. As discussed above, the underside of the flap 28 may also contain an adhesive or sealing agent that will further seal the headlap portion 12*a* to the underlayment 20 when the flap 28 is positioned in the flat position over the headlap portion 12*a*. Additionally, the shingle 10 may also contain a sealing material that is manufactured into or applied over top of the material of the headlap portion 12*a* of the shingle 10 that may also aid in the waterproofing and weathering characteristics of the roofing system. In the embodiments where the nails 50 are applied through the flaps 28, the combination of the flap 28 in conjunction with the subsequent course of roofing shingles 10 placed over the flap 28 and these additional sealing materials that may be used to work together to provide the same superior water and weather proofing characteristics as the embodiment where the nails 50 are applied under the flap 28. The process of applying the roofing shingles 10 to each of the horizontal flaps 28 is repeated to complete the roofing system using the underlayment 20 of the present invention.

In addition to providing superior waterproofing and other weathering characteristics to a completed roofing system, the underlayment 20 of the present invention also provides another specific advantage in that the underlayment 20 can be exposed without shingles 10 for both short and extended periods of time. In the short term, this feature is particularly advantageous both during installation of the roofing system as well as in the event of a disaster that may cause the roof to be damaged. Because the underlayment 20 is made from water impermeable, weather durable materials, exposure of the underlayment 20 for short periods of time without shingles will not compromise the integrity of the roof by permitting water onto the roof deck material. Long term exposure of the underlayment 20 is also feasible. One example of long term exposure of underlayment 20 is a roofing system where a portion of the flap 28 is exposed to provide spacing between two adjacent courses of roofing shingles 10 to produce a "thick looking" effect or a "shadow line" effect at the butt edge of the shingle. Where such a system is used, the thickness of the flap 28 of the underlayment 20 may be adjusted accordingly to accommodate the prolonged exposure of the flap 28.

Additional advantages of an underlayment 20 of the present invention include advantages associated with the economics and production of the alternative headlap construction shingles used in conjunction with the underlayment 20. These advantages include reduced shingle manufacturing cost and increased production throughput for the alternative headlap construction shingles. Additionally, use of the underlayment 20 of the present invention results in simplified installation as a specific advantage of the roofing system of the present invention as well.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An underlayment for use under a plurality of courses of roofing shingles, the underlayment comprising:

a water impermeable membrane layer, wherein the membrane layer contains at least one pleat extending horizontally across the membrane layer;

wherein an upper edge of a roofing shingle is positioned under the pleat such that the upper edge of the roofing shingle is overlapped by the pleat, and wherein the pleat is overlapped by an adjacent course of roofing shingles;

wherein the pleat is integrally formed by folding the membrane layer; and wherein the underlayment further includes a base layer and a reinforcing material that is applied between the base layer and the membrane layer.

2. The underlayment of claim 1 wherein the base layer is formed from an asphalt based material, a polymer material, a foil sheet material, or a combination thereof.

3. The underlayment of claim 2 wherein the reinforcing material includes any combination of fiber reinforcement, mesh, mat, scrim, fabric, filler, fire retardant, and mineral facing materials.

4. The underlayment of claim 1 wherein the flap is permanently attached to a top surface of the membrane layer.

5. The underlayment of claim 1 wherein the membrane layer contains a plurality of spaced apart flaps.

6. The underlayment of claim 1 wherein the vertical width of the flap on the membrane layer is within the range of from about ½ inch to about 3 inches.

7. A roofing system suitable for being applied to a roof deck, wherein the system includes a plurality of courses of roofing shingles and the underlayment according to claim 1, wherein the upper edge of a course of roofing shingles can be positioned under the flap of the underlayment when the flap is in the raised position, wherein the upper edge of the roofing shingle can be subsequently overlapped by the flap when the flap is moved into the flat position, and wherein the flap can be subsequently overlapped by another course of roofing shingles.

8. The underlayment of claim 1 further including:

a base layer; and a reinforcing material applied to the base layer;

wherein the water impermeable membrane layer is applied over the base layer and reinforcing material.

9. A roofing system suitable for being applied to a roof deck, the system comprising:

a plurality of courses of roofing shingles; and an underlayment layer disposed over the roofing deck, the underlayment layer comprising a water impermeable membrane layer, wherein the membrane layer contains a plurality of spaced apart flaps extending horizontally across the membrane layer;

wherein an upper edge of a roofing shingle is positioned under each flap, such that the upper edge of the roofing shingle is overlapped by a flap, and wherein the flaps are overlapped by adjacent courses of roofing shingles;

wherein the underlayment layer comprises the membrane layer secured to a base layer with a reinforcing material applied thereon, and wherein the base layer and reinforcing material are applied under the membrane layer; and wherein the flaps of the membrane layer are configured in the form of pleats integrally formed by folding the membrane layer.

10. The roofing system of claim 9 wherein a layer of sealing material is applied between the flaps and the portions of the shingles disposed underneath the flaps.

11. The roofing system of claim 9 wherein the vertical width of the flap on the membrane layer is within the range of from about ½ inch to about 3 inches.

12. The roofing system of claim 9 wherein the roofing shingles are comprised of a headlap portion and a buttlap portion, wherein the vertical width of the headlap portion is within the range of from about 20 percent to about 40 percent of the overall vertical width of the roofing shingle.

13. The roofing system of claim 9 wherein the shingles are secured to the underlayment layer and the roof deck by placing mechanical fasteners underneath the flap and through the portion of the upper edge of the roofing shingle that is subsequently covered by the flap when the flap is moved into the flat position.

14. The roofing system of claim 9 wherein the shingles are secured to the underlayment layer and the roof deck by placing mechanical fasteners through the flap and the portion of the upper edge of the roofing shingle that is covered by the flap when the flap is in the flat position.

* * * * *